US006578556B2

(12) United States Patent
Ricco et al.

(10) Patent No.: US 6,578,556 B2
(45) Date of Patent: Jun. 17, 2003

(54) DEVICE AND METHOD FOR CONTROLLING AN ELECTROMAGNET CONTROLLING A METERING VALVE OF AN INTERNAL COMBUSTION ENGINE FUEL INJECTOR

(75) Inventors: Mario Ricco, Casamassima (IT); Stefano Maria Borrione, Turin (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 63 days.

(21) Appl. No.: 09/966,770

(22) Filed: Sep. 28, 2001

(65) Prior Publication Data

US 2002/0066438 A1 Jun. 6, 2002

(30) Foreign Application Priority Data

Sep. 29, 2000 (IT) ..... TO2000A0911

(51) Int. Cl.[7] ..... F02D 41/20; H01H 47/00
(52) U.S. Cl. ..... 123/490; 361/154
(58) Field of Search ..... 123/490; 361/154, 361/155

(56) References Cited

U.S. PATENT DOCUMENTS 5,818,679 A * 10/1998 Schustek et al. ..... 361/154
5,947,090 A * 9/1999 Maeda ..... 123/490
5,992,391 A * 11/1999 Yamakado et al. ..... 123/490
6,142,124 A * 11/2000 Fischer et al. ..... 123/490
6,333,843 B2 * 12/2001 Boie et al. ..... 361/154 X

* cited by examiner

*Primary Examiner*—Tony M. Argenbright
(74) *Attorney, Agent, or Firm*—Pennie & Edmonds LLP

(57) ABSTRACT

The device has an electric circuit for generating a first electric current of such a predetermined value as to excite the electromagnet to open the metering valve, and a second electric current of a lower value such as to keep the electromagnet excited; and a timing device for controlling the electric circuit as a function of operating conditions of the engine. The timing device also controls the electric circuit in such a manner as to vary the duration of the first current as a function of the operating temperature of the engine.

10 Claims, 2 Drawing Sheets

DEVICE AND METHOD FOR CONTROLLING AN ELECTROMAGNET CONTROLLING A METERING VALVE OF AN INTERNAL COMBUSTION ENGINE FUEL INJECTOR

The present invention relates to a device and method for controlling an electromagnet controlling a metering valve of an internal combustion engine fuel injector.

BACKGROUND OF THE INVENTION

As is known, a metering valve is normally opened by exciting an electromagnet controlling the valve. Excitation of the electromagnet commences at a given instant depending on the stroke of the corresponding engine cylinder, and is effected by a first current. After a given delay, sufficient to ensure the valve is opened completely, the first current is replaced by a second current, which is lower, e.g. about half, the first current, to simply keep the electromagnet excited and the valve open. The instant the second current ceases depends on the amount of fuel required by the engine, so that the total excitation time of the electromagnet depends on the operating conditions, e.g. speed, torque, etc., of the engine.

Owing to the hysteresis of the electromagnet core, which depends on the type of material used, the decay time of the magnetic field of the coil varies with time, so that the electromagnet is excited by a current whose time graph, as of the first instant, comprises a portion increasing rapidly to a substantially constant first current, a portion decreasing to a lower second current from another instant having a predetermined delay with respect to the first, and a portion in which the second current decreases to zero from a second instant.

In known control devices, the delay is selected to ensure the valve opens in any condition, in particular with any engine and fuel temperature, and is therefore fairly long. The transition in the excitation of the electromagnet, from the higher to the lower current, results in nonlinearity of the quantity of fuel injected as a function of excitation time. Moreover, in known devices and in certain engine operating conditions, nonlinearity frequently occurs at a critical point in the operation of the engine, thus resulting in irregular power output.

SUMMARY OF THE INVENTION

It is an object of the present invention to provide a device and method for controlling an electromagnet controlling a fuel injector metering valve, which are highly straightforward and reliable, and provide for eliminating the aforementioned drawbacks typically associated with known devices.

According to the present invention, there is provided a device for controlling an electromagnet controlling a metering valve of a fuel injector of an internal combustion engine, and which comprises an electric circuit for generating a first electric current of such a predetermined value as to excite said electromagnet to open said metering valve; said electric circuit generating a second electric current of a value lower than said predetermined value and such as to keep said electromagnet so excited; timing means being provided to control said electric circuit as a function of operating conditions of said engine; and the device being characterized in that said timing means also control said electric circuit in such a manner as to vary the duration of said first current as a function of the operating temperature of said engine.

According to the relative control method, the electromagnet is first excited by a first electric current of such a predetermined value as to open the metering valve, and is subsequently kept excited by a second electric current of a value lower than said predetermined value; the method being characterized by varying the duration of said first current as a function of the operating temperature of said engine.

BRIEF DESCRIPTION OF THE DRAWINGS

A preferred, non-limiting embodiment of the invention will be described by way of example with reference to the accompanying drawings, in which.

DETAILED DESCRIPTION OF THE INVENTION

Figure 1:
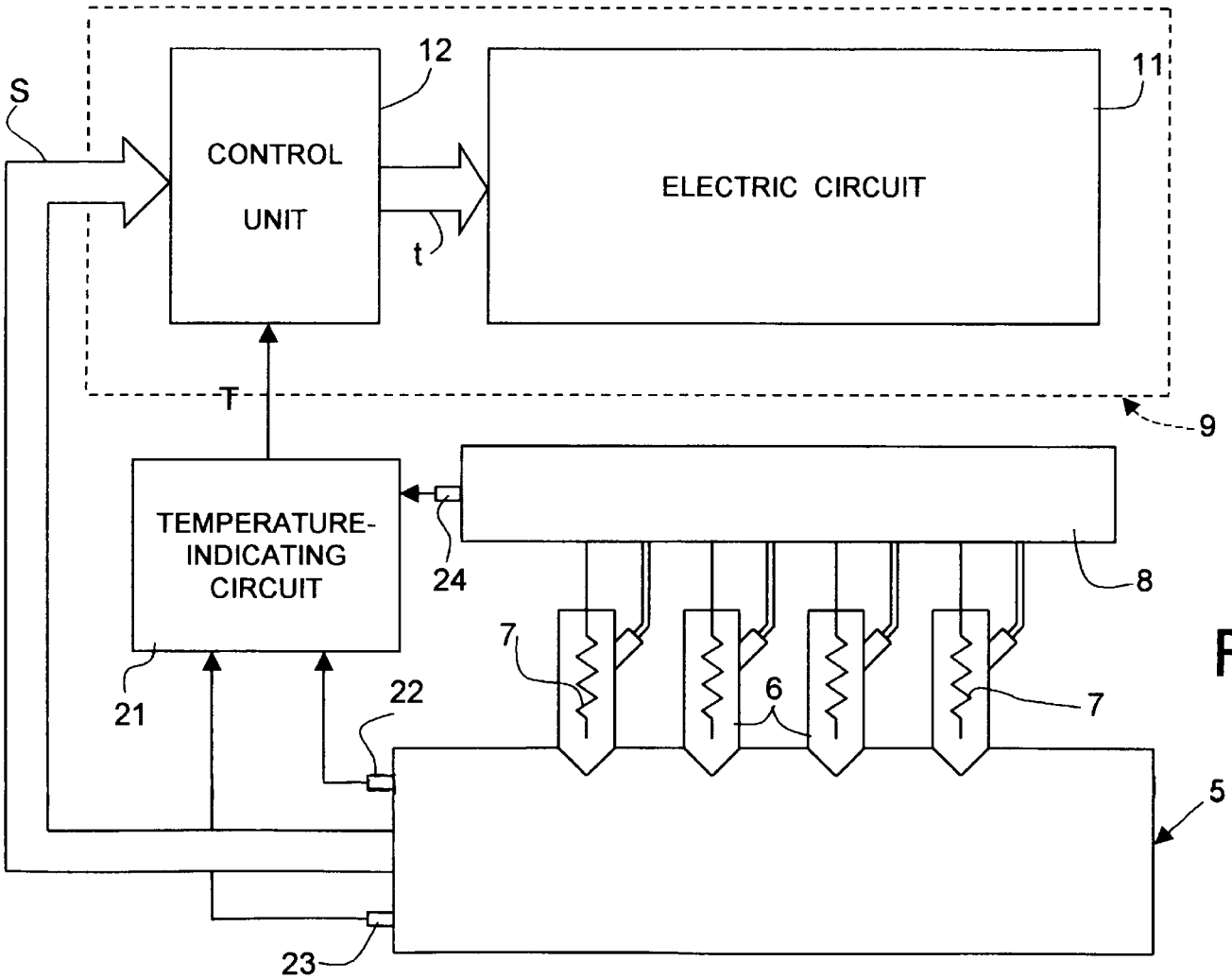
FIG. 1 shows a block diagram of an electromagnet control device in accordance with the invention.

Number 5 in FIG. 1 indicates as a whole an internal combustion engine, e.g. a diesel engine, having a number of cylinders, each supplied with high-pressure fuel by a known injector 6. Each injector 6 is activated by a metering valve controlled by a corresponding electromagnet 7. More specifically, injectors 6 are connected to a common fuel vessel or so-called "common rail" 8 to which fuel is pumped from the usual fuel tank.

Electromagnets 7 are controlled by a control device, indicated as a whole by 9, which comprises an electric circuit 11 controlled by timing means, e.g. an electronic control unit 12, as a function of the operating conditions of engine 5. For this purpose, control unit 12 receives information signals S measured on engine 5—e.g. engine speed, required power or torque, the stroke of each cylinder—and generates timing signals t which are used by circuit 11 to control electromagnets 7.

To control each electromagnet 7, electric circuit 11 generates a first electric current 13 (FIG. 2) of such a predetermined value as to excite each electromagnet 7 to open the metering valve; and a second electric current 14 of a value lower than that of current 13, and which keeps electromagnet 7 excited at minimum energy cost. After a given duration of first current 13, second current 14 is therefore substituted for the first to keep the metering valve open.

First current 13 may advantageously be of a mean value of about 20 A, and second current 14 of about 10 A. Electric circuit 11 may be of the type described in the Applicant's Italian Patent Application n° TO96A000637, in which the control unit defines a first instant t1 at which excitation of electromagnet 7 commences, a second instant t2 at which excitation is terminated, and an intermediate instant t3 at which first current 13 is terminated.

Figure 2:
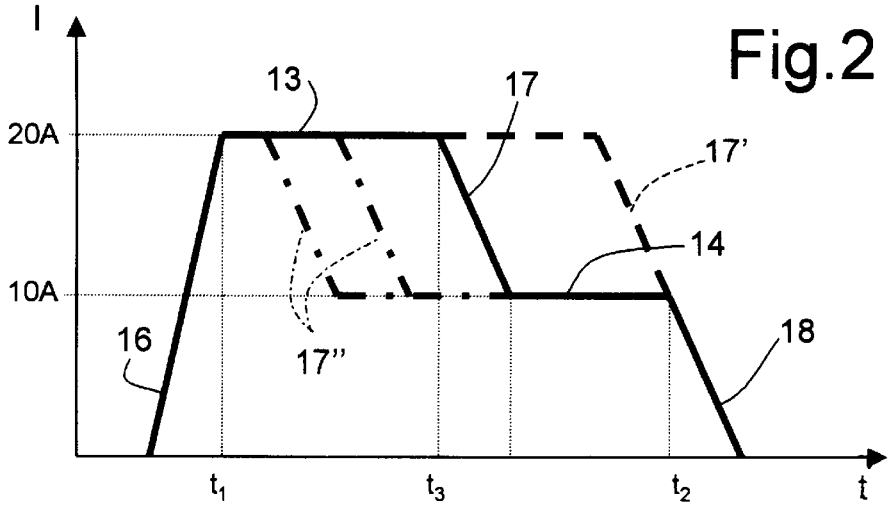
FIGS. 2–4 show operating graphs of the FIG. 1 device.

The FIG. 2 graph shows the excitation current I of electromagnet 7 as a function of time t, and comprises, as of first instant t1, a portion 16 increasing rapidly to a value defining first current 13, which actually increases slightly, on account of the structure of selected circuit 11. As of intermediate instant t3, the current I graph comprises a portion 17 decreasing rapidly to a value defining second current 14, and, as of instant t2, another portion 18 in which second current 14 decreases rapidly to zero.

Figure 3:
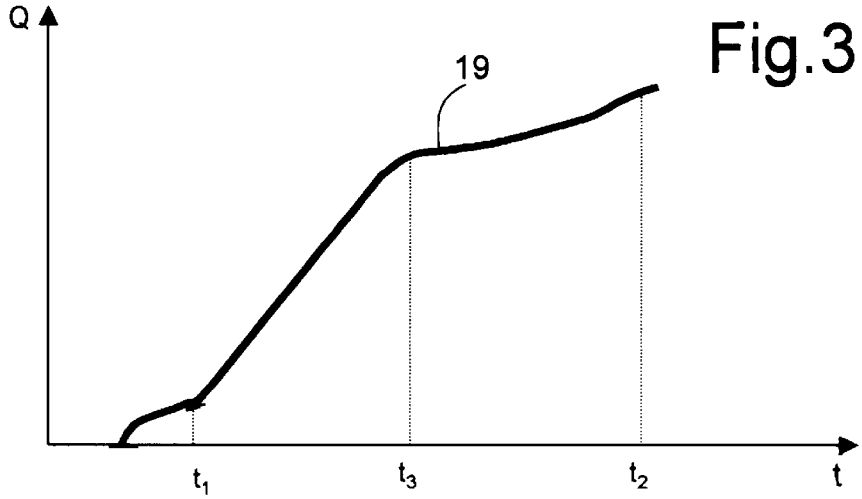

The FIG. 3 graph shows the quantity Q of fuel injected as a function of the excitation time of the electromagnet. As can be seen, portion 17 creates a transition in the excitation of electromagnet 7, from higher current 13 to lower current 14, which produces a portion 19 in which a nonlinear quantity Q of fuel is injected as a function of excitation time.

Being constant in known control devices, instant t3 must be selected to ensure the metering valve opens in any temperature and operating condition of the engine, so that delay t3–t1 is extremely long, and nonlinearity portion 19 often occurs at a critical point in the operation of the engine. For example, at idling speed, instant t2 may occur before current I reaches the current 14 value, thus increasing the duration of portion 18.

According to the invention, control unit 12 controls electric circuit 11 to vary the duration of current 13 as a function of the operating temperature of engine 5. More specifically, control device 9 comprises a temperature-indicating circuit 21, which emits an electric temperature signal T as a function of the temperatures detected by sensors at one or more points on engine 5, e.g. as a function of the mean of said temperatures; and signal T is processed by control unit 12 to determine instant t3, i.e. the duration of higher current 13.

For this purpose, circuit 21 receives a signal from a sensor 22 for detecting the cooling water temperature of engine 5; a signal from an engine lubricating oil temperature sensor 23; and a signal from a fuel temperature sensor 24 located, for example, in the common rail. The signal T emitted by circuit 21 may indicate the mean of the temperatures detected by sensors 22–24. In winter and when engine 5 is cold, the above temperatures are obviously much lower than in summer and when engine 5 is running steadily.

Under the control of signal T from circuit 21, control unit 12 varies instant t3 so that the duration of first current 13 is maximum when signal T indicates a temperature of −40° C. or lower, is minimum when signal T indicates a temperature of −10° C. or higher, and is thus increased appropriately at low temperatures.

Figure 4:
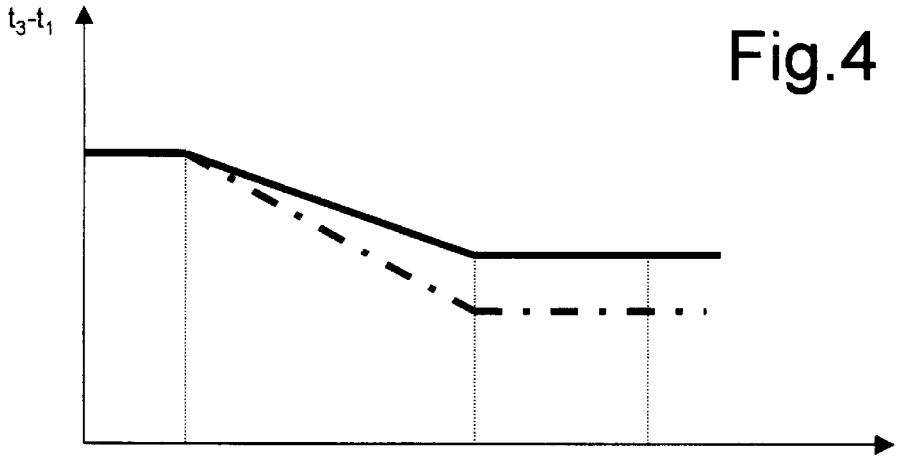

FIG. 4 shows a graph of duration t3–t1 as a function of the temperature indicated by signal T, and which varies from a maximum of about 400 μsec to a minimum ranging between 250 and 150 μsec, depending on the type of injection system on which control device 9 is used.

In FIG. 2, the dash line indicates the portion 17' in which first current 13 decreases in the case of a temperature of −40° C. or lower, and the dot-and-dash lines indicate the portions 17" in which current 13 decreases, and in which the decrease may vary, in the case of a temperature of −10° C. or higher. Instant t3 determining portion 17' is preferably such that decreasing portion 17' does not exceed decreasing portion 18 of second current 14 in any operating condition of engine 5.

Control device 9 therefore implements a method of controlling an electromagnet 7 controlling the metering valve of a fuel injector 6, in which electromagnet 7 is first excited by a first electric current 13 of such a predetermined value as to excite electromagnet 7 to open the metering valve, and is subsequently kept excited by a lower second electric current 14 to keep the metering valve open; the duration t3–t1 of first current 13 being varied as a function of the operating temperature of engine 5.

The advantages, with respect to known technology, of the control device and method according to the invention will be clear from the foregoing description. In particular, the duration of current 13 is reduced at temperatures over −10° C., so that, even when engine 5 is idling, instant t2 never occurs at the transition point in the operation of engine 5.

Clearly, changes may be made to the device and method as described herein without, however, departing from the scope of the accompanying Claims.

What is claimed is:

1. A device for controlling an electromagnet (7) controlling a metering valve of a fuel injector (6) of an internal combustion engine (5), and which comprises an electric circuit (11) for generating a first electric current (13) of such a predetermined value as to excite said electromagnet (7) to open said metering valve; said electric circuit (11) generating a second electric current (14) of a value lower than said predetermined value and such as to keep said electromagnet (7) so excited; timing means (12) being provided to control said electric circuit (11) as a function of operating conditions of said engine; and the device being characterized in that said timing means also control said electric circuit (11) in such a manner as to vary the duration (t3–t1) of said first current (13) as a function of the operating temperature of said engine (5).

2. A device as claimed in claim 1, wherein said timing means (12) define a first instant (t1) at which said first current (13) starts, and a second instant (t2) at which said second current (14) ends; characterized by comprising a sensor (22–24) for detecting the temperature of the engine (5) and/or of the fuel to be injected, so as to emit a corresponding electric signal (T); said timing means (12) defining a third instant (t3) at which said first current (13) is replaced by said second current (14), as a function of said electric signal (T).

3. A device as claimed in claim 2, characterized in that said timing means (12) vary said third instant (t3) so that said duration (t3–t1) is maximum when said electric signal (T) corresponds to a temperature of −40° C. or lower, and is minimum when said electric signal (T) corresponds to a temperature of −10° C. or higher.

4. A device as claimed in claim 3, characterized in that said electric signal (T) varies said duration (t3–t1) between a maximum value of about 400 μsec and a minimum value ranging between 250 and 150 μsec.

5. A device as claimed in claim 3, characterized by comprising a temperature-indicating circuit (21) which emits said electric signal (T) as a function of the temperature detected by at least two of the following temperature sensors: a sensor (22) for detecting the temperature of the cooling water of the engine (5); a sensor (23) for detecting the temperature of the lubricating oil of the engine (5); a sensor (24) for detecting the temperature of the fuel to be injected by the injector (6).

6. A method of controlling an electromagnet controlling a metering valve of a fuel injector (6) of an internal combustion engine (5), wherein said electromagnet (7) is first excited by a first electric current (13) of such a predetermined value as to excite said electromagnet (7), and is subsequently kept excited by a second electric current (14) of a value lower than said predetermined value; the method being characterized by varying the duration (t3–t1) of said first current (13) as a function of the operating temperature of said engine (5).

7. A method as claimed in claim 6, characterized in that said duration (t3–t1) is controlled as a function of the temperature of the engine (5) and/or of the temperature of the fuel to be injected, so as to define a variable instant (t3) at which said first current (13) is replaced by said second current (14).

8. A method as claimed in claim 7, characterized in that said instant (t3) is so varied that the duration of said first current (13) is maximum when said temperature is −40° C. or lower, and is minimum when said temperature is −10° C. or higher.

9. A method as claimed in claim 8, characterized in that said duration (t3–t1) is varied between a maximum value of about 400 μsec and a minimum value ranging between 250 and 150 μsec.

10. A method as claimed in claim 8, characterized in that said duration (t3–t1) is varied as a function of the temperature detected from at least two of the following heat sources: the cooling water of the engine (5); the lubricating oil of the engine (5); the fuel to be injected by the injector (6).

* * * * *